US005823854A

United States Patent [19]

Chen

[11] Patent Number: 5,823,854

[45] Date of Patent: Oct. 20, 1998

[54] CHEMICAL-MECHANICAL POLISH (CMP) PAD CONDITIONER

[75] Inventor: Lai-Juh Chen, Hsin-Chu, Taiwan

[73] Assignee: Industrial Technology Research Institute, Hsinchu, Taiwan

[21] Appl. No.: 654,503

[22] Filed: May 28, 1996

[51] Int. Cl.[6] ..... B24B 49/00; B24B 51/00

[52] U.S. Cl. ..... 451/9; 451/9; 451/41; 451/285

[58] Field of Search ..... 451/41, 285, 5, 451/8, 9, 286, 287, 288; 156/645.1, 636.1; 437/228.7

[56] References Cited

U.S. PATENT DOCUMENTS

| | | | |
|---|---|---|---|
| 5,032,203 | 7/1991 | Doy et al. | 156/345 |
| 5,132,617 | 7/1992 | Leach et al. | 451/8 |
| 5,232,875 | 8/1993 | Tuttle et al. | 437/225 |
| 5,310,455 | 5/1994 | Pasch et al. | 156/636 |
| 5,320,706 | 6/1994 | Blackwell | 156/636 |
| 5,481,475 | 1/1996 | Young | 364/491 |
| 5,492,594 | 2/1996 | Burke et al. | 451/28 |
| 5,562,529 | 10/1996 | Kishii et al. | 451/36 |
| 5,575,706 | 11/1996 | Tsai et al. | 451/41 |
| 5,637,031 | 6/1997 | Chen | 451/41 |

*Primary Examiner*—Timothy V. Eley
*Assistant Examiner*—Derris H. Banks
*Attorney, Agent, or Firm*—George O. Saile; Stephen B. Ackerman

[57] ABSTRACT

An improved and new apparatus and process for conditioning a chemical-mechanical polishing (CMP) pad has been developed, wherein sufficient conditioning is assured in order to restore the "fresh pad" polish removal rate performance of the polishing pad, while at the same time prolong the life of the CMP polishing pad. The result is a lower cost process and improved product throughput for the CMP apparatus.

8 Claims, 8 Drawing Sheets

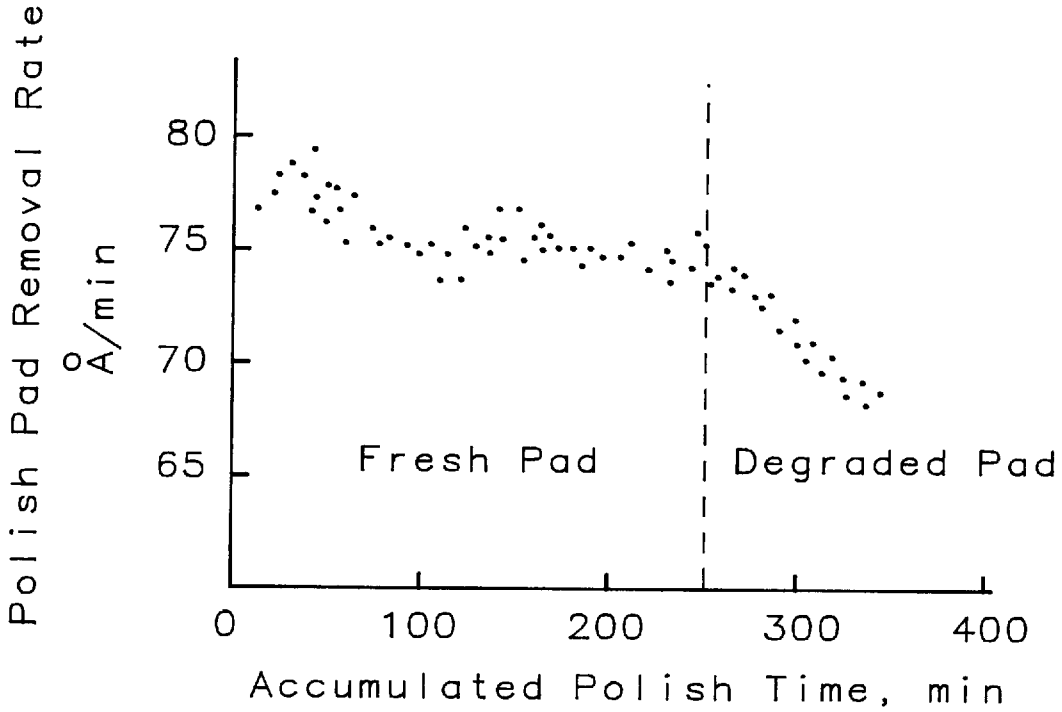
FIG. 1 — Prior Art

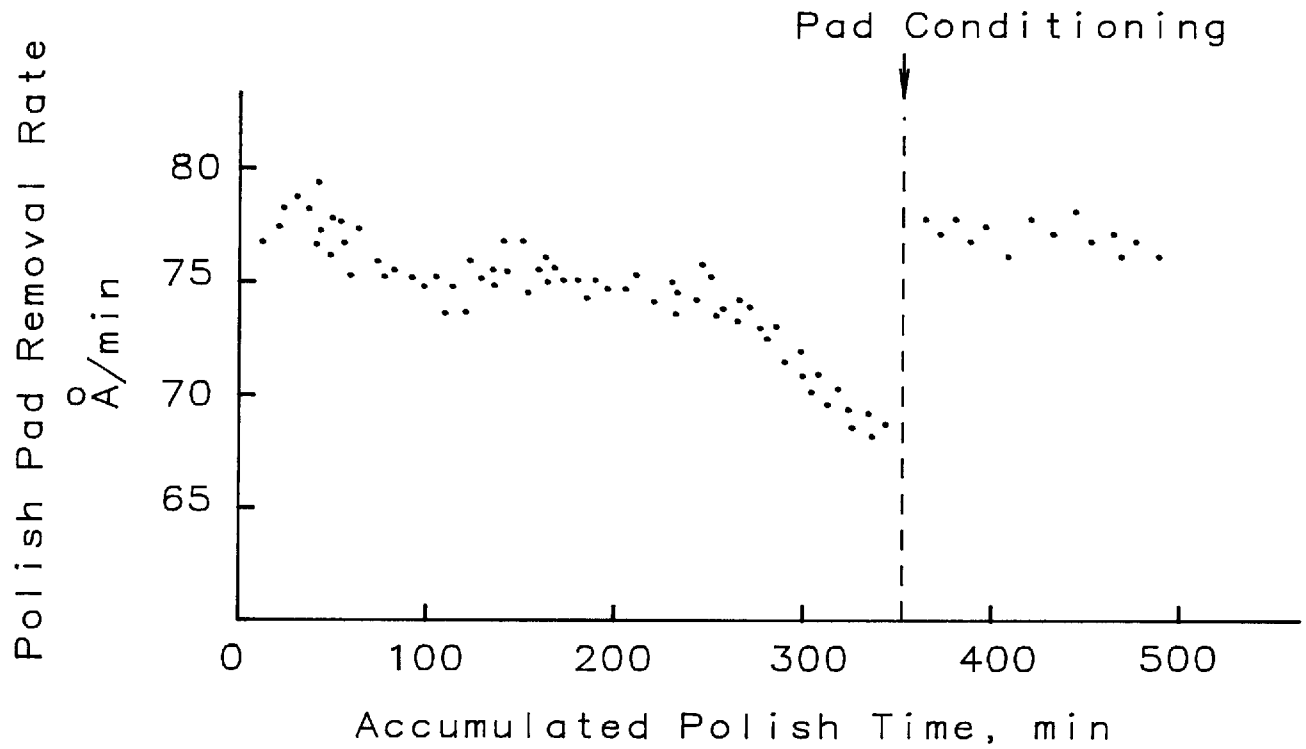
FIG. 2 – Prior Art

CHEMICAL-MECHANICAL POLISH (CMP) PAD CONDITIONER

BACKGROUND OF THE INVENTION (1) Field of the Invention

This invention relates to an apparatus and method for chemical-mechanical polishing (CMP) a semiconductor substrate and more particularly to an apparatus and method for conditioning the polishing pad in order to control the polish removal rate and prolong the life of the polishing pad.

(2) Description of Related Art

Chemical-mechanical polishing (CMP) has been developed for providing smooth topographies on surfaces deposited on semiconductor substrates. Rough topography results when metal conductor lines are formed over a substrate containing device circuitry. The metal conductor lines serve to interconnect discrete devices, and thus form integrated circuits. The metal conductor lines are further insulated from the next interconnection level by thin layers of insulating material and holes formed through the insulating layers provide electrical access between successive conductive interconnection layers. In such wiring processes, it is desirable that the insulating layers have a smooth surface topography, since it is difficult to lithographically image and pattern layers applied to rough surfaces. CMP can, also, be used to remove different layers of material from the surface of a semiconductor substrate. For example, following via hole formation in an insulating material layer, a metallization layer is blanket deposited and then CMP is used to produce planar metal studs.

Briefly, the CMP processes involve holding and rotating a thin, flat substrate of the semiconductor material against a wetted polishing surface under controlled chemical, pressure and temperature conditions. A chemical slurry containing a polishing agent, such as alumina or silica, is used as the abrasive material. Additionally, the chemical slurry contains selected chemicals which etch various surfaces of the substrate during processing. The combination of mechanical and chemical removal of material during polishing results in superior planarization of the polished surface.

The wetted polishing surface comprises a porous pad material, such as blown polyurethane, saturated with the polishing slurry. Mounting of the polishing pad to the polishing apparatus is a labor intensive operation and the mounting process, also, interrupts use of the polishing apparatus. The initial cost of the polishing pad, labor cost for mounting the pad to the polishing apparatus, and reduced throughput of the apparatus due to the polishing apparatus down-time while mounting the polishing pad add to the cost of polished product. Therefore, it is desirable to prolong the life of a polishing pad. A principal factor in polishing pad degradation is a phenomenon referred to as "glazing", in which, during use, abrasive particles from the polishing slurry and polished by-product become embedded and packed into the pores of the polishing pad. The result of "glazing" is a reduction of polish removal rate and under-polishing of product until a correction is made. FIG. 1 shows polish pad removal rate versus accumulated polishing time on a polishing pad. In this example, the polishing pad removal rate is significantly degraded after about 250 min. of accumulated polishing time. A technique used to overcome "glazing" is to periodically condition the polishing pad to rid the pad of embedded abrasive particles and polished by-product. State-of-the-art conditioning techniques include liquid rinsing, air blowing the polishing pad surface, and grinding of the polishing pad surface to expose a fresh surface. The grinding technique is typically accomplished by using a rotating diamond wheel to remove a portion of the pad surface. FIG. 2 shows polish pad removal rate versus accumulated polishing time, degradation of the polish pad removal rate over time, and restoration of the polish pad removal rate following pad conditioning using grinding with a diamond wheel to remove a layer of the polish pad surface. In this example, pad conditioning at about 350 min. accumulated polish time, restores the degraded polish pad removal rate to the "fresh pad" removal rate. It is important to know when pad conditioning is necessary and when the pad conditioning operation is effective. Unnecessary cost is added to the polishing process if pad conditioning is done before "glazing" has reduced the polish removal rate. It is, also, important to know when the pad conditioning operation is effective because under-conditioning will not restore the polish removal rate to the "fresh pad" polish removal rate and over-conditioning will excessively consume the polishing pad and will thereby decrease the polish pad life.

Polish pad life is a subject of concern in current CMP technology, as shown in the U.S. Pat. Nos. 5,310,455 and 5,232,875. U.S. Pat. No. 5,310,455 entitled "Techniques For Assembling Polishing Pads For Chemi-Mechanical Polishing of Silicon Wafers" granted May 10, 1994 to Nicholas F. Pasch et al describes a method of mounting polishing pads to a polishing apparatus, wherein the polishing slurry solution is diverted away from the adhesive interface between pads, thereby prolonging the life of the polishing pad by reducing catastrophic delamination of the polishing pad from the polishing apparatus. U.S. Pat. No. 5,232,875 entitled "Method and Apparatus For Improving Planarity of Chemical-Mechanical Planarization Operations" granted Aug. 3, 1993 to Mark E. Tuttle et al describes an improved polishing pad having a porous surface and perforations which extend from a lower surface thereof to an upper surface thereof. The perforations effect efficient distribution of the polishing slurry and prolong the life of the polishing pad.

The present invention is directed to a novel method and apparatus for dynamic control of polishing pad conditioning processes in order to prolong the life of the polishing pad, maintain the non-degraded polish removal rate for the polishing pad, and improve the product throughput of the polishing apparatus.

SUMMARY OF THE INVENTION

One object of the present invention is to provide an improved and new apparatus and method for conditioning a polishing pad in a chemical-mechanical polishing (CMP) apparatus.

Another object of the present invention is to provide a new and improved apparatus and method for conditioning a CMP polishing pad, wherein the life of the CMP polishing pad is prolonged.

A further object of the present invention is to provide a new and improved apparatus and method for conditioning a CMP polishing pad, wherein sufficient conditioning is assured in order to restore the "fresh pad" polish removal rate performance of the polishing pad, while at the same time prolong the life of the CMP polishing pad.

In an illustrative embodiment, apparatus for carrying out the method of the invention comprises: a semiconductor substrate carrier and rotating polishing platen for chemically-mechanically polishing (CMP) the semiconductor substrate; a rotating polishing pad with a counter-electrode embedded within; means of dispensing a chemical-mechanical polishing slurry onto the polishing pad; a rotating pad conditioner having an abrasive surface afixed thereon and a plurality of electrodes embedded in the pad conditioner holder and abrasive surface; means of applying a constant voltage between each electrode embedded in the pad conditioner and the counter-electrode embedded within the rotating polishing pad; means of measuring the current density for each electrode among the plurality of electrodes embedded in the pad conditioner holder and abrasive surface during the pad conditioning operation; means of storing in a computer memory data for current density versus polish pad conditioning time for each electrode among the plurality of electrodes embedded in the pad conditioner; means of integrating the measured current density with polish pad conditioning time for each electrode among the plurality of electrodes embedded in the pad conditioner; means of storing in a computer memory factors, generally called "Sherwood Numbers", which are the integrated current density with polish pad conditioning time for each electrode; means to compare, for each electrode, the "computed Sherwood Number" during conditioning of a "used polish pad" to the "stored Sherwood Number" of a "fresh polish pad"; means to detect online the difference between the "computed Sherwood Number" and the "stored Sherwood Number; and a means to change online a conditioning parameter, e.g pressure between the conditioning grinding wheel and polishing pad or rotation speed of the grinding wheel, when a difference is detected between the "computed Sherwood Number" and the "stored Sherwood Number". The dynamic, online monitoring of the conditioning process prolongs the life of the polishing pad by preventing over-conditioning which unwarrantly consumes the polishing pad. The dynamic, online monitoring of the conditioning process, also, assures sufficient conditioning to restore the "fresh pad" polish removal rate for the polishing process.

BRIEF DESCRIPTION OF THE DRAWINGS

The object and other advantages of this invention are best described in the preferred embodiments with reference to the attached drawings that include:

FIG. 1, which shows polish pad removal rate versus accumulated polishing time on a polishing pad.

FIG. 2, which shows polish pad removal rate versus accumulated polishing time and restoration of the polish pad removal rate following pad conditioning.

DESCRIPTION OF THE PREFERRED EMBODIMENTS

The new and improved CMP apparatus and method of planarizing the surface of a semiconductor substrate using chemical/mechanical polishing (CMP) and polish pad conditioning, wherein sufficient conditioning is assured in order to restore the "fresh pad" polish removal rate performance of the polishing pad, while at the same time prolonging the life of the CMP polishing pad, will now be described in detail. The method can be used for planarizing insulator surfaces, such as silicon oxide or silicon nitride, deposited by CVD (Chemical Vapor Deposition), LPCVD (Low Pressure Chemical Vapor Deposition) or PE-CVD (Plasma Enhanced Chemical Vapor Deposition) or insulating layers, such as glasses deposited by spin-on and reflow deposition techniques, over semiconductor devices and/or conductor interconnection wiring patterns. The method can, also, be applied when CMP is used to remove different layers of material from the surface of a semiconductor substrate. For example, following via hole formation in a dielectric material layer, a metallization layer, such as tungsten or copper, is blanket deposited and then CMP is used to produce planar metal studs.

Figure 3A:
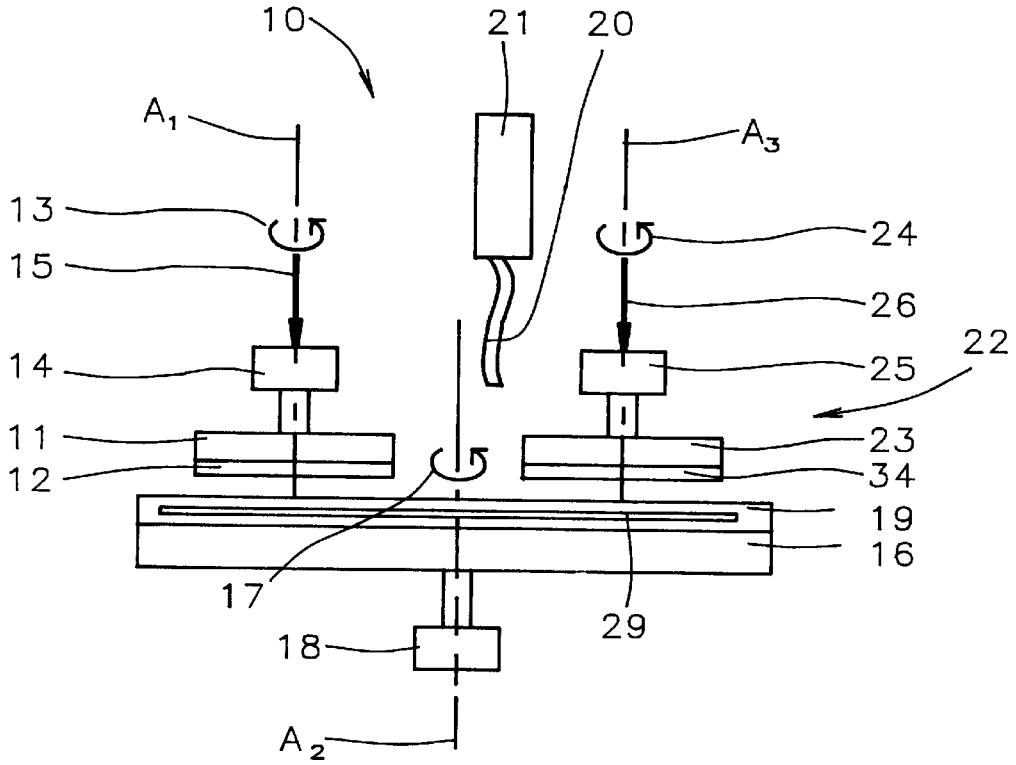
FIG. 3A, which schematically, in cross-sectional representation, illustrates a polishing apparatus and polish pad conditioning apparatus, used in accordance with the method of the invention.
Figure 3B:
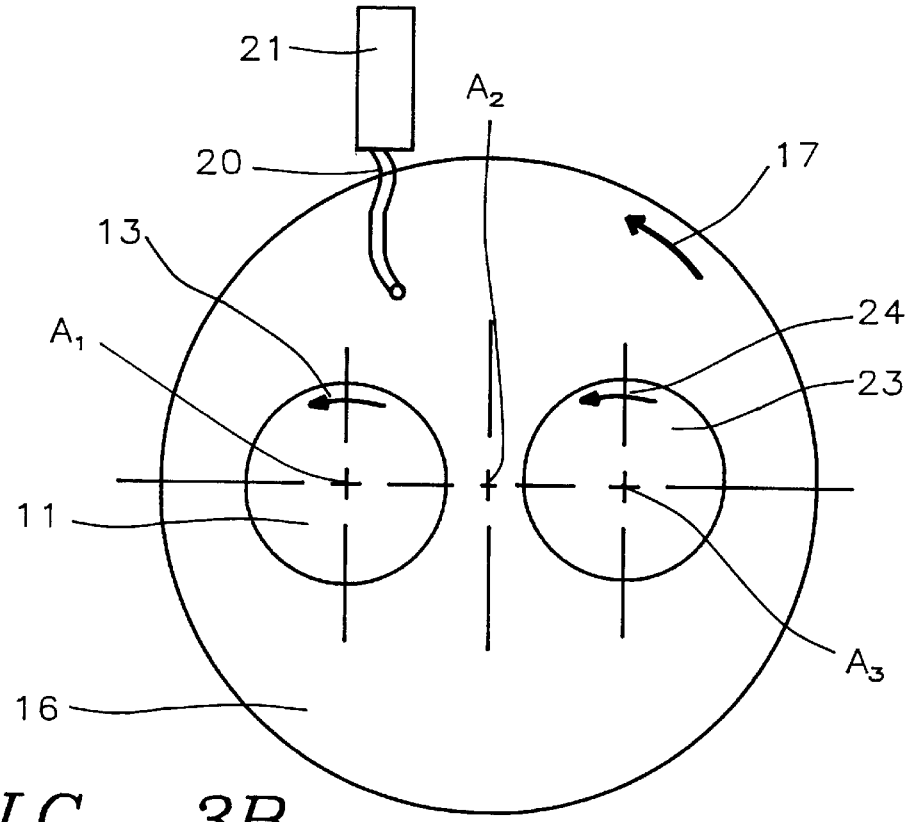
FIG. 3B, which is a top view of the apparatus illustrated in FIG. 3A.
Figure 4A:
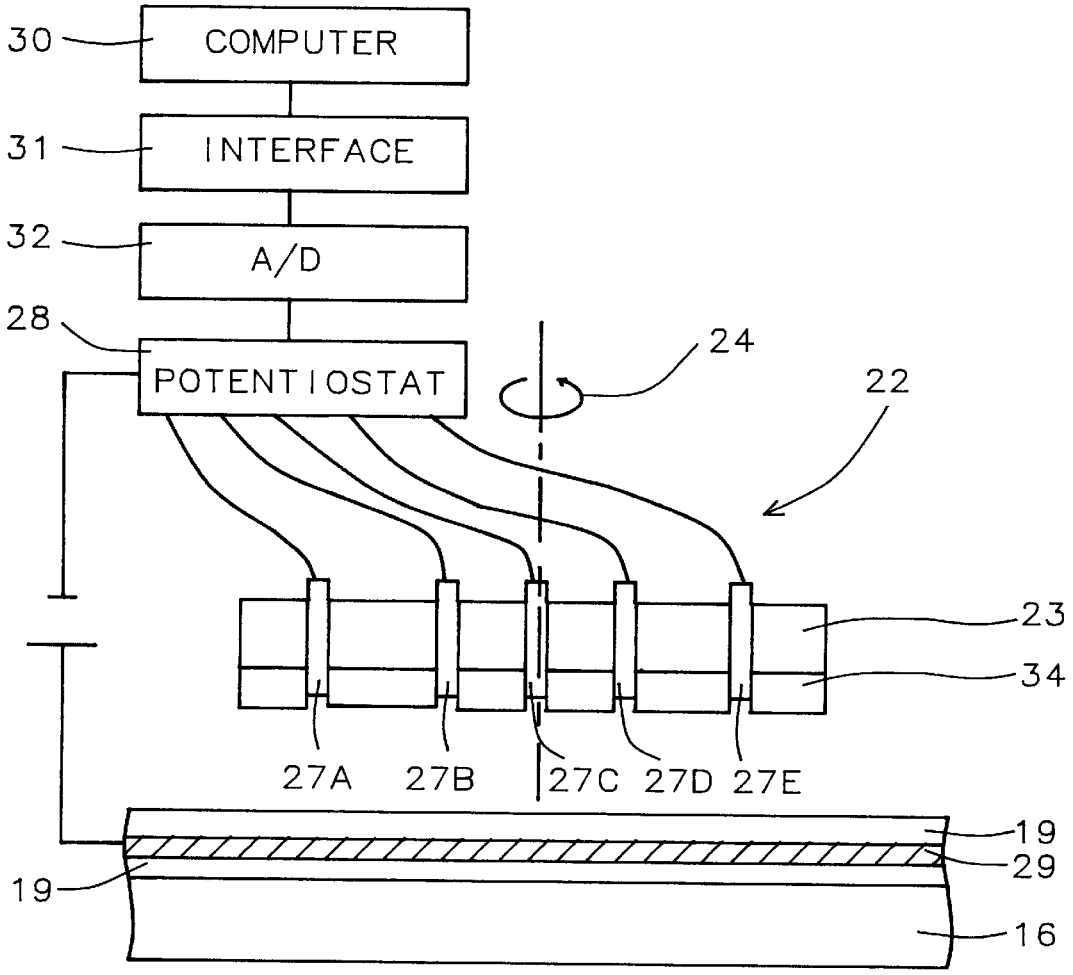
FIG. 4A, which schematically, in cross-sectional representation, illustrates the polish pad conditioner.
Figure 4B:
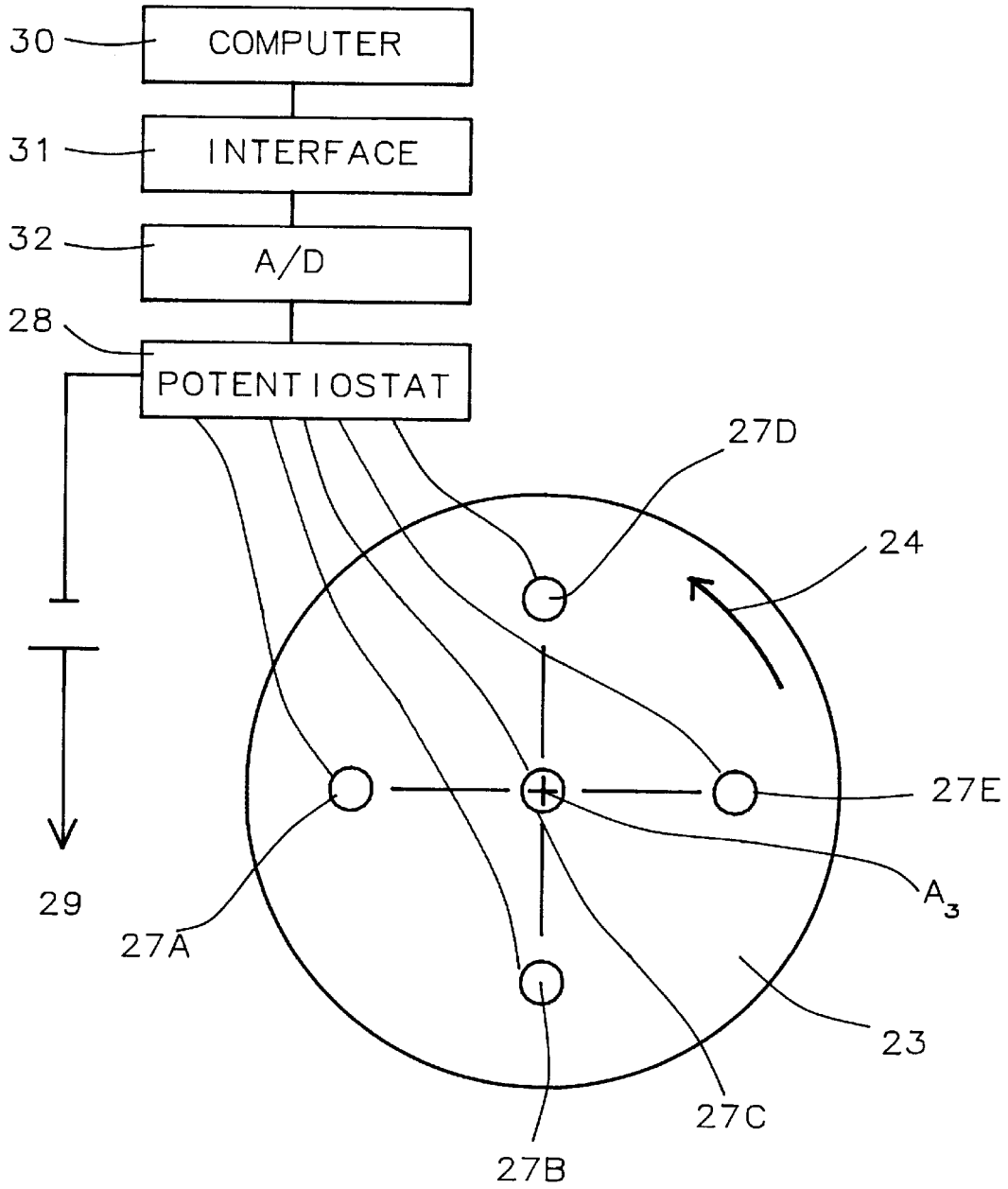
FIG. 4B, which is a top view of the polish pad conditioner illustrated in FIG. 4A.

FIGS. 3A and 3B are schematic views of a chemical-mechanical polishing (CMP) apparatus for use in accordance with the method of the invention. In FIG. 3A, the CMP apparatus, generally designated as 10, is shown schematically in cross-sectional representation. The CMP apparatus, 10, includes a wafer carrier, 11, for holding a semiconductor wafer, 12. The wafer carrier, 11, is mounted for continuous rotation about axis, A1, in a direction indicated by arrow, 13, by drive motor, 14. The wafer carrier, 11, is adapted so that a force indicated by arrow, 15, is exerted on semiconductor wafer, 12. The CMP apparatus, 10, also includes a polishing platen, 16, mounted for continuous rotation about axis, A2, in a direction indicated by arrow, 17, by drive motor, 18. A polishing pad, 19, formed of a material such as blown polyurethane, is mounted to the polishing platen, 16. Embedded within the polishing pad, 19, is a counter-electrode, 29. A polishing slurry containing an abrasive fluid, such as silica or alumina abrasive particles suspended in either a basic or an acidic solution, is dispensed onto the polishing pad, 19, through a conduit, 20, from a reservoir, 21. In this invention a critical feature of the apparatus is the polish pad conditioner, generally designated as 22 in FIGS. 3A and 3B. The polish pad conditioner, 22, comprises a holder, 23, to which is mounted an abrasive grinding layer, 34, such as a polishing pad impregnated with diamond particles. The holder, 23, is adapted for continuous rotation about axis, A3, in a direction indicated by arrow, 24, by drive motor, 25. The holder, 23, is further adapted so that a force indicated by arrow, 26, is exerted on the grinding layer, 34. FIGS. 4A and 4B further illustrate the polish pad conditioner, 22. FIG. 4A is a cross-sectional representation of the polish pad conditioner, 22, and FIG. 4B is a top view of the polish pad conditioner, 22, illustrated in FIG. 4A. The polish pad conditioner, 22, has embedded in the abrasive grinding layer, 34, and holder, 23, a plurality of electrodes, 27A to 27E. In this example, five nickel electrodes are illustrated; however, the number, location and material of the electrodes may be changed to meet the needs of the process. Referring now to FIGS. 4A and 4B, each nickel electrode is attached to a potentiostat, 28, which supplies a constant voltage between about 0.5 to 5.0 volts between each electrode and the counter-electrode, 29, embedded within the rotating polishing pad, 19. The potentiostat, 28, also contains a means of measuring the current in each electrode, 27A to 27E. The current density in each electrode, obtained by dividing the current measurement by the cross-sectional area of the electrode, is stored in computer memory, 30, through use of a conventional IEEE/488 interface, 31, and a conventional analog-to-digital (AID) converter, 32. FIG. 3B is a top view of the apparatus illustrated in FIG. 3A.

The dynamic method of controlling the polish pad conditioning will now be described in detail. Generally polish pad conditioning is effected by bringing the abrasive grinding layer, 34, into contact with the rotating polishing pad, 19; saturating the polishing pad, 19, with the polishing slurry; rotating the holder, 23, and abrasive grinding layer, 34, between about 10 to 100 rpm; and applying a pressure between about 1 to 10 psi between the abrasive grinding layer, 34, and the polishing pad, 19. During polish pad conditioning the wafer carrier, 11, is retracted and semiconductor wafer, 12, is not in contact with the polishing pad, 19. During polish pad conditioning the polishing pad, 19, is rotated between about 10 to 100 rpm .

Figure 5A:
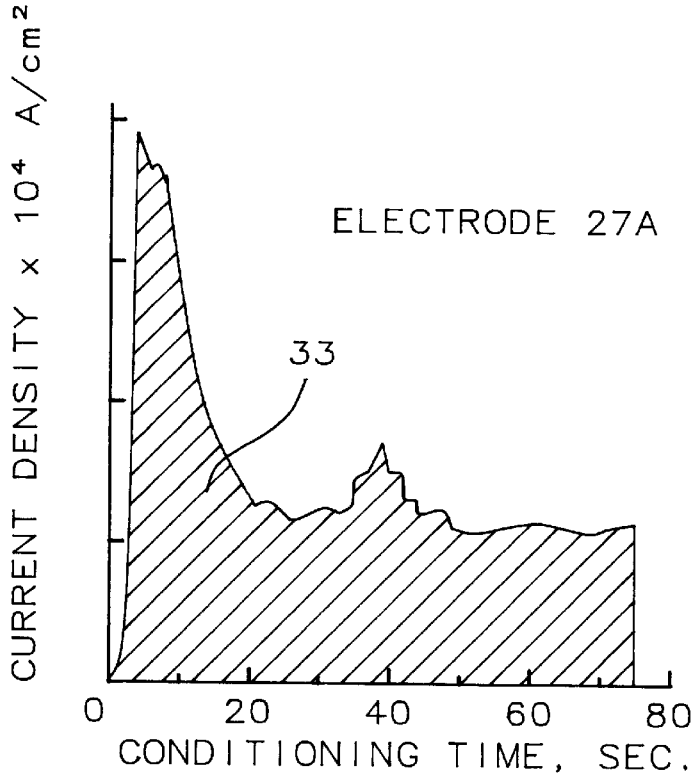
FIG. 5, which shows electrode current density versus conditioning time for two electrodes embedded in the polish pad conditioner.
Figure 5B:
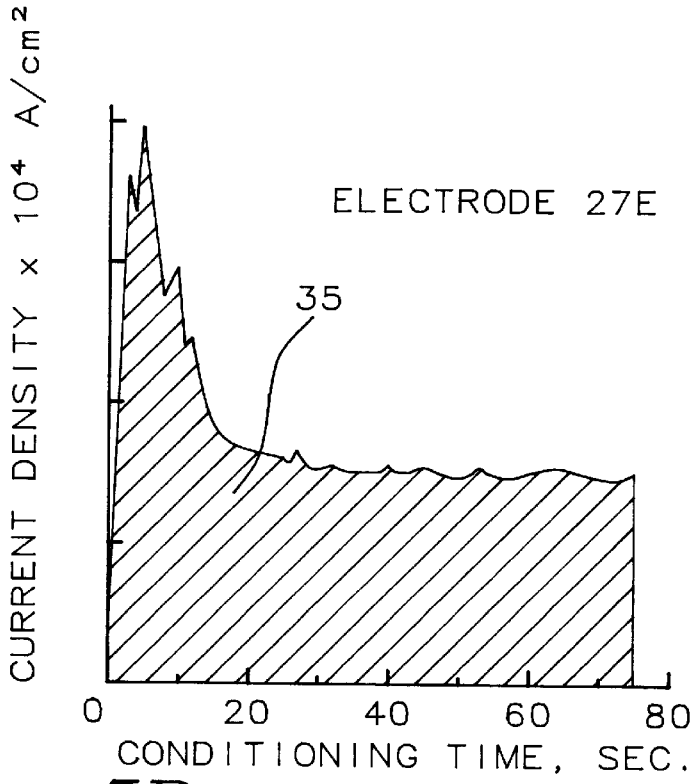
Figure 6A:
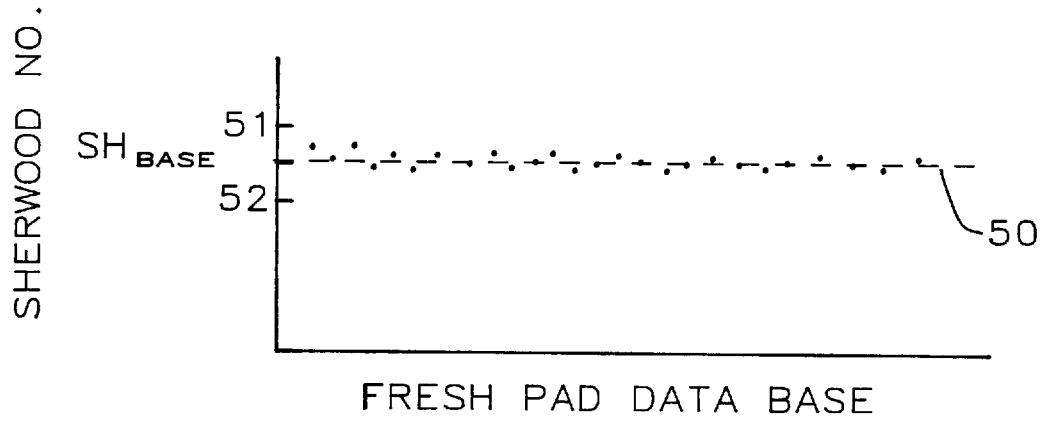
FIG. 6A, which shows "Sherwood Number" baseline data for a "fresh" polish pad.

During application of the constant voltage by the potentiostat, 28, to each nickel electrode, 27A to 27E, the current density in each electrode is measured as a function of conditioning time and stored in computer memory, 30, through use of a conventional IEEE/488 interface, 31, and a conventional analog-to-digital (A/D) converter, 32. In t his preferred embodiment the applied constant voltage is 1.5 volts; however, the applied constant voltage can be between about 0.5 to 5.0 volts. FIG. 5 shows electrode current density versus conditioning time for two nickel electrodes embedded in an abrasive grinding layer comprising a polishing pad impregnated with diamond particles. In this example, the polishing slurry contains a ferrocyanide salt, such as potassium ferrocyanide, in solution with a conventional CMP slurry, Cabot slurry SC-12. Integration of the individual electrode current densities with conditioning time is a measure of the mass transfer rate of the slurry flow at each electrode. For electrode, 27A, this is the area, designated as 33, under the current density curve for electrode 27A. For electrode, 27E, this is the area, designated as 35, under the current density curve for electrode 27E. The result of the integration is generally called the "Sherwood Number". As stated the "Sherwood Number" represents the mass transfer rate of the slurry flow and is, therefore, a measure of the polish removal rate. A decrease in "Sherwood Number" indicates that the polish removal rate has decreased. Baseline data, as represented by the "Sherwood Number", for the mass transfer rate of a "fresh" polish pad are obtained by conditioning a "fresh" polish pad. Such data are illustrated in FIG. 6A. The baseline "Sherwood Number" for a "fresh" polish pad has a value $Sh_{Base}$, designated 50 and an acceptable range of values between limits designated 51 and 52. Baseline data are stored in computer memory, 30.

Figure 6B:
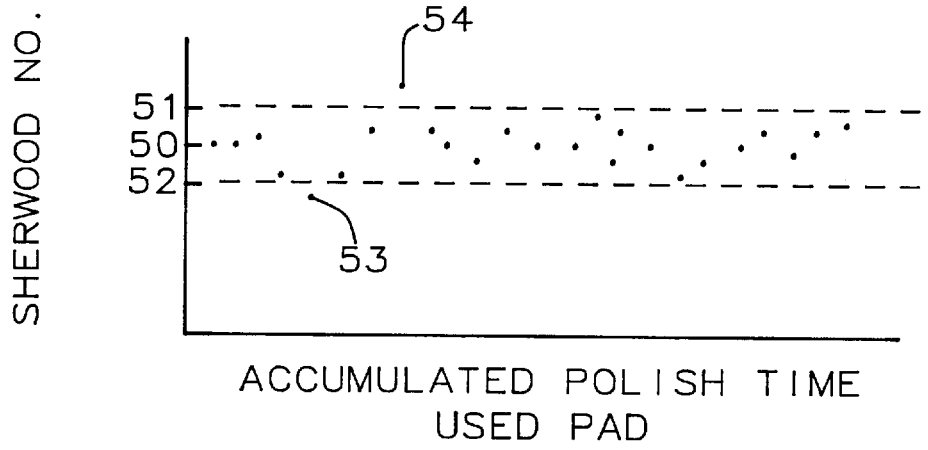
FIG. 6B, which shows dynamically computed "Sherwood Number" data and results of dynamic control of conditioning parameters.
Figure 7:
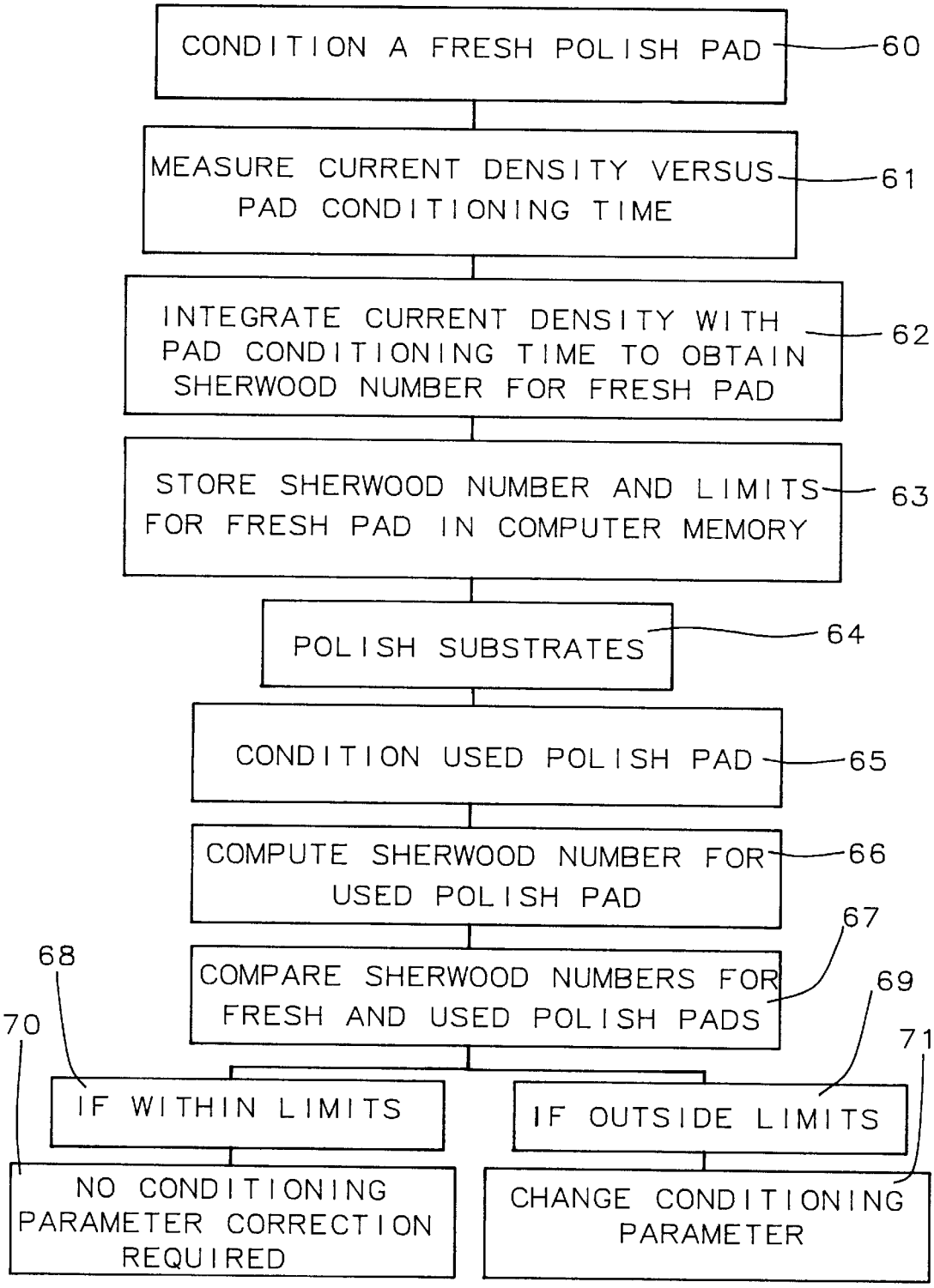
FIG. 7, which is a flow chart of the method of the present invention.

FIG. 6B illustrates dynamic control of pad conditioning by changing pad conditioning parameters when the computed "Sherwood Number" deviates from the stored baseline "Sherwood Number", 50. If the computed "Sherwood Number" is outside the limit range, 51 to 52, for the baseline "Sherwood Number" for a "fresh" polish pad, then a change is made in a pad conditioning parameter to either increase the pad conditioning or reduce the pad conditioning. Computed "Sherwood Numbers" outside the limit range are indicated by 53 and 54. "Sherwood Number" 53 indicates insufficient polish pad conditioning and a correction is made to a conditioning parameter, such as increasing the pressure between the conditioning grinding wheel and polishing pad or increasing the rotation speed of the grinding wheel. Following this correction the computed "Sherwood Numbers" are within the acceptable range. "Sherwood Number" 54 indicates over conditioning and a correction is made to a conditioning parameter to reduce the amount of pad conditioning. For example, the pressure between the conditioning grinding wheel and the polishing pad is reduced, the rotation speed of the grinding wheel is reduced, or the conditioning time is reduced. Again, following this correction the computed "Sherwood Numbers" are within the acceptable range. A flow chart for the basic steps of the method of the invention is shown in FIG. 7. Steps 60 to 63 condition a fresh polish pad in order to compute a "Sherwood Number" for a fresh pad. Step 64 is CMP of semiconductor substrates. Steps 65 and 66 condition the used polish pad and compute the "Sherwood Number" for the used pad. Step 67 compares the "Sherwood Numbers" for the fresh and used polish pads and results in the decision tree, Steps 68 to 71.

While the invention has been particularly shown and described with reference to the preferred embodiments thereof, it will be understood by those skilled in the art that various changes in form and details may be made without departing from the spirit and scope of the invention.

What is claimed is:

1. A method for conditioning a polishing pad comprising the steps of:

providing said polishing pad affixed to a rotatable polishing platen, said polishing pad having a counter-electrode embedded therein;

providing a rotating pad conditioner having an abrasive surface affixed thereon, a pad conditioner holder, and a plurality of electrodes embedded in the pad conditioner holder and abrasive surface;

providing a means for holding said abrasive surface of said rotating pad conditioner in juxtaposition relative to said rotating polishing pad with an applied pressure between the pad conditioner and the polishing pad;

dispensing a polishing slurry onto said rotating polishing pad;

applying a constant voltage between each electrode embedded in said rotating pad conditioner and said counter-electrode embedded within said rotating polishing pad;

measuring current density in each said embedded electrode during the pad conditioning operation;

storing in a computer memory data for current density versus polish pad conditioning time for each said electrode among the plurality of electrodes embedded in said rotating pad conditioner;

integrating the measured current density with polish pad conditioning time for each said electrode among the plurality of electrodes embedded in said rotating pad conditioner;

storing in a computer memory factors, known as Sherwood Numbers, which are the integrated current density with polish pad conditioning time for each said electrode among the plurality of electrodes embedded in said rotating pad conditioner;

comparing, for each electrode, a computed Sherwood Number during conditioning of a used polish pad to a stored Sherwood Number from a fresh polish pad;

detecting the difference between the computed Sherwood Number and the stored Sherwood Number; and changing a conditioning parameter when a difference is detected between the computed Sherwood Number and the stored Sherwood Number.

2. The method of claim 1, wherein said polishing slurry comprises silica or alumina and polishing chemicals and $H_2O$ at a pH between about pH=2 to pH=12.

3. The method of claim 1, wherein said abrasive surface afixed to said rotating pad conditioner is a polyurethane pad impregnated with diamond particles.

4. The method of claim 1, wherein said rotating polishing pad is rotated at a speed between about 10 to 100 rpm.

5. The method of claim 1, wherein said rotating pad conditioner is rotated at a speed between about 10 to 100 rpm.

6. The method of claim 1, wherein said applied pressure between the pad conditioner and the polishing pad is between about 1 to 10 psi.

7. The method of claim 1, wherein said constant voltage applied between each electrode embedded in said rotating pad conditioner and said counter-electrode embedded within said rotating polishing pad is between about 0.5 to 5.0 volts.

8. The method of claim 1, where at least one electrode is embedded in said pad conditioner holder and abrasive surface.

* * * * *